US005346810A

United States Patent [19]

Ohno

[11] Patent Number: 5,346,810

[45] Date of Patent: Sep. 13, 1994

[54] SILVER HALIDE PHOTOGRAPHIC MATERIAL

[75] Inventor: Shigeru Ohno, Kanagawa, Japan

[73] Assignee: Fuji Photo Film Co., Ltd., Kanagawa, Japan

[21] Appl. No.: 3,476

[22] Filed: Jan. 12, 1993

[30] Foreign Application Priority Data

Jan. 20, 1992 [JP] Japan ..... 4-27548

[51] Int. Cl.[5] ..... G03C 1/06

[52] U.S. Cl. ..... 430/522; 430/517; 430/539

[58] Field of Search ..... 430/522, 517, 539

[56] References Cited

FOREIGN PATENT DOCUMENTS 0015601 9/1980 European Pat. Off. .
0021513 1/1981 European Pat. Off. .
0423693 4/1991 European Pat. Off. .
1077049 7/1967 United Kingdom .

*Primary Examiner*—Jack P. Brammer
*Attorney, Agent, or Firm*—Sughrue, Mion, Zinn, Macpeak & Seas

[57] ABSTRACT

Disclosed is a silver halide photographic material having a hydrophilic colloid layer which contains a dispersion of solid fine grains of an oxonole dye which does not have any dissociating proton-containing substituent or salt thereof capable of dissolving the dye during development, except the enolic proton constituting a part of the chromophoric group of the dye in the compound. In the photographic material, the oxonole dye colors only the specific hydrophilic layer without having any bad effect on the photographic properties of the material. The dye may be rapidly decolored by development of the material.

17 Claims, No Drawings

SILVER HALIDE PHOTOGRAPHIC MATERIAL

FIELD OF THE INVENTION

The present invention relates to a silver halide photographic material containing a dispersion of solid fine grains of a novel compound (i.e., compound dispersed in the form of solid fine grains).

BACKGROUND OF THE INVENTION

In a silver halide photographic material, coloration of the photographic emulsion layers and other hydrophilic colloid layers constituting the material is often modified for the purpose of controlling the spectral composition of the light to be applied to the material or for the purpose of preventing halation or irradiation of the material. It is necessary only that the layer to which the dye has been added is selectively colored therewith in order that the dye does not impart any harmful spectral effect to the other layers and that the dye sufficiently displays filter, anti-halation and anti-irradiation effects. However, when the layer to which the dye has been added is kept in contact with other hydrophilic colloid layers in a wet condition, a part of the dye often diffuses from the former to the latter. In order to prevent such diffusion of the dye, various efforts have heretofore been made.

For instance, a method of coloring a specific layer with solid fine grains of a water-insoluble dye is illustrated in JP-A-56-12639, JP-A-55-155350, JP-A-55-155351, JP-A-63-197943, European Patents 15,601, 274,723, 276,566, and 299,435, U.S. Pat. No. 4,803,150, and International Patent Application Laid-Open No. (WO)88/04794. (The term "JP-A" as used herein means an "unexamined published Japanese patent application".)

Specifically, a method using solid fine grains of an oxonole dye is illustrated in JP-A-52-92716, JP-A-55-120030, JP-A-63-27838, JP-A-64-40827, JP-A-2-277044, JP-A2-282244, JP-A-3-23441, JP-A-3-208044, JP-A-3-192250, JP-A-3-194544, JP-A-3-200248, JP-A-3-204639, JP-A-3-204640, JP-A-3-206441, JP-A-3-206442, JP-A-3-208042, JP-A-3-208043, and JP-A-3-213847.

The improved methods still suffer from various problems. The decoloration rate in development is low so that the disclosed techniques do not satisfactorily modify the characteristics of the photographic materials. For instance, when a photographic material is processed by rapid processing or with a modified processing solution, or when the composition of the photographic emulsion constituting a photographic material is modified, the decoloring function is not always sufficiently displayed or the dye incorporated into the photographic material often has a bad influence on the photographic properties of the material.

SUMMARY OF THE INVENTION

One object of the present invention is to provide a photographic material containing a dye which may color a specific hydrophilic colloid layer in the material and which may be decolored rapidly during development of the material. Another object of the present invention is to provide a photographic material containing a dye which may color a specific hydrophilic colloid layer in the material and which may be decolored rapidly during development of the material without having any bad influence on the photographic emulsions constituting the material.

The present inventors have found that these and other objects may be attained by a silver halide photographic material comprising a support being containing a hydrophilic colloid layer which contains a dispersion of solid fine grains of a compound of the following formula (I):

$$A_1 \neq L_1 - L_2 \rangle_m L_3 - (L_4 = L_5)_n A_2 \qquad (I)$$

wherein $A_1$ and $A_2$ each represents an acidic nucleus necessary for forming an oxonole dye, excepting the case where $A_1$ and $A_2$ are both 2-pyrazolin-5-one nuclei, the case where they are both barbituric acid nuclei, and the case where .they are both 2,6(1H,3H)-pyridinedione nuclei; $L_1$, $L_2$, $L_3$, $L_4$ and $L_5$ each represents a methine group; and m and n each represents 0, 1 or 2; provided that the compound does not have any dissociating proton-containing substituent or salt thereof capable of dissolving the compound during development, except for the enolic proton such as a hydroxyl group constituting a part of the chromophoric group of an oxonole dye.

Specific examples of dissociating proton-containing substituent or salt thereof include a sulfonic acid group, a phosphoric acid group, a carboxylic acid group, a sulfonamido group having from 1 to 10 carbon atoms (e.g., methanesulfonamido, decanesulfonamido, butanesulfonamido, hexanesulfonamide, isobutanesulfonamido, benzenesulfonamido, octanesulfonamido), an arylsulfamoyl group having from 6 to 10 carbon atoms (e.g., phenylsulfamoyl, naphthylsulfamoyl, tolylsulfamoyl), an acylsulfamoyl group having from 1 to 10 carbon atoms (e.g., acetylsulfamoyl, butanoylsulfamoyl, octanoylsulfamoyl, decanoylsulfamoyl, benzoylsulfamoyl), a sulfonylcarbamoyl group having from 2 to 11 carbon atoms (e.g., methanesulfonylcarbamoyl, propanesulfonylcarbamoyl, hexanesulfonylcarbamoyt, decanesulfonylcarbamoyl, benzenesulfonylcarbamoyl), and a salt thereof (e.g., an inorganic salt of Li, Na, K, $NH_3$, an organic amine salt of triethylamine, tetrabutylammonium, pyridine).

DETAILED DESCRIPTION OF THE INVENTION

Compounds of formula (I) are described in detail hereunder.

The acidic nucleus represented by $A_1$ or $A_2$ is preferably a cyclic ketomethylene compound residue or a ketomethylene compound residue substituted by electron-attracting groups. Especially preferred is the case where at least one of $A_1$ and $A_2$ represents a pyrazolo[3,4-b]pyridine-3,6-dione nucleus or a 2(5H)-furanone nucleus. Specific examples of the nucleus are shown below, as keto forms or their analogues:

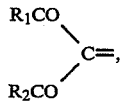
(A-1)

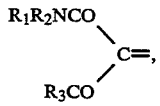
(A-2)

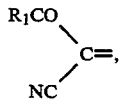
(A-3)

-continued
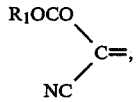
(A-4)
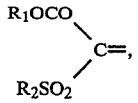
(A-5)
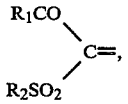
(A-6)
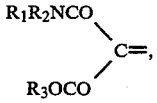
(A-7)
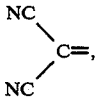
(A-8)
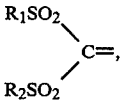
(A-9)
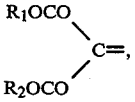
(A-10)
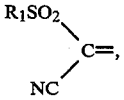
(A-11)
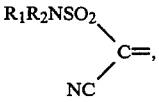
(A-12)
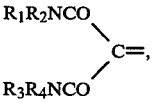
(A-13)
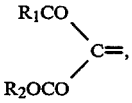
(A-14)
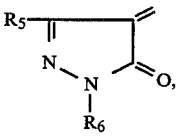
(A-15)
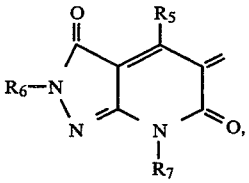
(A-16)
-continued
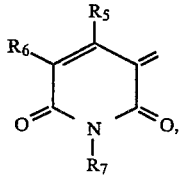
(A-17)
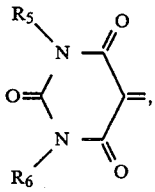
(A-18)
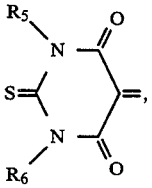
(A-19)
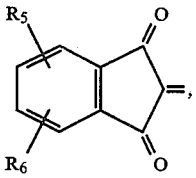
(A-20)
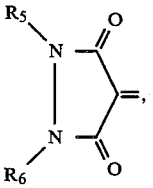
(A-21)
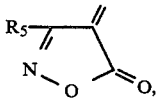
(A-22)
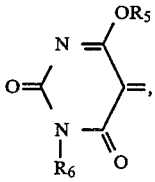
(A-23)
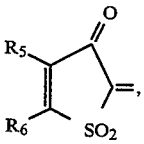
(A-24)
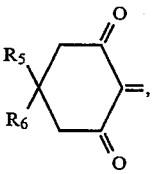
(A-25)

-continued
(A-26)
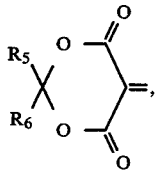
(A-27)
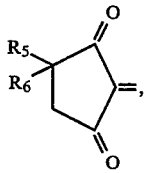
(A-28)
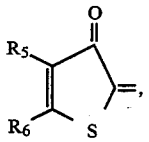
(A-29)
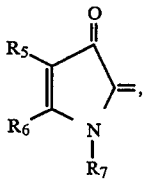
(A-30)
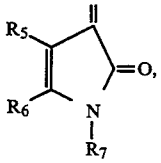
(A-31)
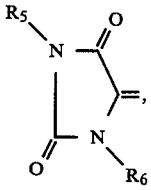
(A-32)
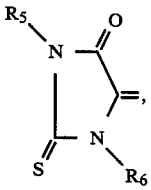
(A-33)
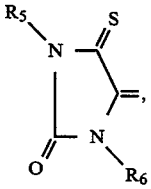
(A-34)
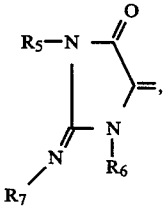
-continued
(A-35)
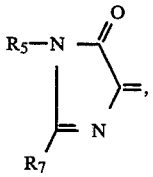
(A-36)
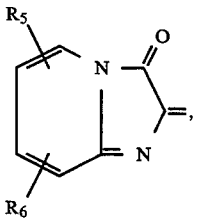
(A-37)
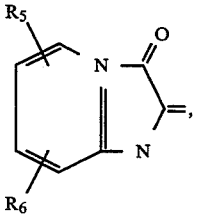
(A-38)
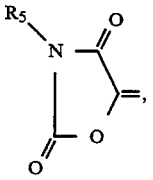
(A-39)
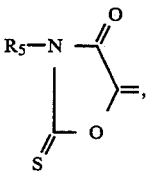
(A-40)
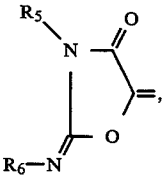
(A-41)
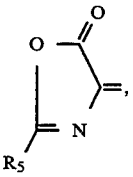
(A-42)
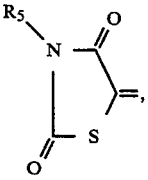

-continued (A-43)

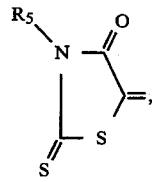

(A-44)

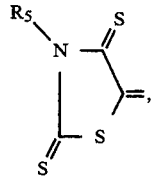

(A-45)

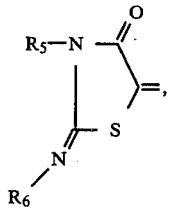

(A-46)

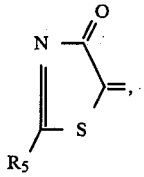

(A-47)

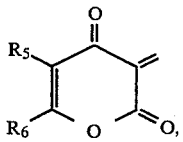

(A-48)

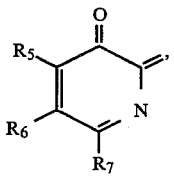

(A-49)

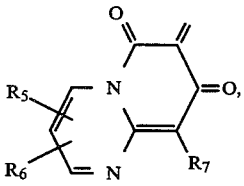

(A-50)

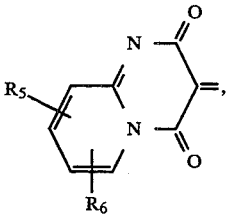

-continued (A-51)

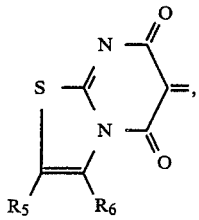

(A-52)

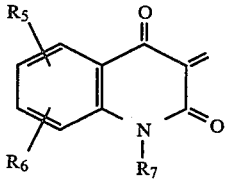

(A-53)

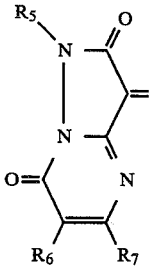

(A-54)

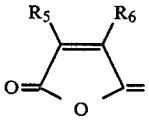

(A-55)

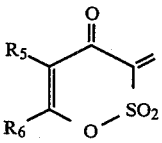

In these formulae, $R_1$, $R_2$, $R_3$ and $R_4$ each represents an alkyl group, an aryl group, a heterocyclic group or an alkenyl group; and $R_5$, $R_6$ and $R_7$ each represents a hydrogen atom or a substituent. $R_1$ and $R_2$, $R_3$ and $R_4$, or $R_5$ and $R_6$ may be bonded to each other to form a 5-membered or 6-membered ring.

The substituents in these formulae are not specifically limited, provided that they do not substantially dissolve the compound of formula (I) in water having pH of from 5 to 7 such as a sulfonic acid group and a salt thereof, a phosphoric acid group and a salt thereof, or a carboxylic acid group and a salt thereof. For instance, suitable substituents include an alkyl group having from 1 to 8 carbon atoms (e.g., methyl, ethyl, isopropyl, butyl, hexyl, octyl, 2-hydroxyethyl), an alkoxy group having from 1 to 8 carbon atoms (e.g., methoxy, ethoxy, butoxy), a halogen atom (e.g., chlorine, bromine, fluorine), an amino group having from 0 to 10 carbon atoms (e.g., dimethylamino, diethylamino, cyanoethylamino), an ester group having from 2 to 10 carbon atoms (e.g., methoxycarbonyl, ethoxycarbonyl, phenoxycarbonyl), an amido group (e.g., acetylamino, benzamido), a carbamoyl group having from 1 to 10 carbon atoms (e.g., methylcarbamoyl, ethylcarbamoyl), a sulfamoyl group having from 0 to 10 carbon atoms (e.g., methylsulfamoyl, butylsulfamoyl), an aryl group having from 6 to 10 carbon atoms (e.g., phenyl, naphthyl, 4-methoxyphenyl, 3-methylphenyl), an acyl group having from 2 to 10 carbon atoms (e.g., acetyl, benzoyl, propanoyl), a sulfonyl group having from 1 to 10 carbon atoms (e.g., methanesulfonyl, benzenesulfonyl), a ureido group having from 1 to 10 carbon atoms (e.g., ureido, methylureido), a urethane group having from 2 to 10 carbon atoms (e.g., methoxycarbonylamino, ethoxycarbonylamino), a sulfonate group (e.g., methoxysulfonyl, phenoxysulfonyl), a cyano group, a hydroxyl group, a nitro group, and a heterocyclic group (e.g., benzoxazole ring, pyridine ring, sulforan ring, furan ring).

The alkyl group represented by $R_1$, $R_2$, $R_3$ or $R_4$ is preferably an alkyl group having from 1 to 10 carbon atoms (e.g., methyl, ethyl, benzyl, phenethyl, propyl, butyl, isobutyl, pentyl, hexyl, octyl, nonyl) which may optionally have substituent (s) (such as those mentioned above, excepting an alkyl group).

The aryl group represented by $R_1$, $R_2$, $R_3$ or $R_4$ is preferably an aryl group having from 6 to 10 carbon atoms (e.g., phenyl, naphthyl) which may have substituent(s) (such as those mentioned above).

The heterocyclic group represented by $R_1$, $R_2$, $R_3$ or $R_4$ is preferably a 5-membered or 6-membered heterocyclic group (e.g., oxazole ring, benzoxazole ring, thiazole ring, imidazole ring, pyridine ring, furan ring, thiophene ring, sulforan ring, pyrazole ring, pyrrole ring, chroman ring, coumarin ring) which may have substituent(s) (such as those mentioned above).

The alkenyl group represented by $R_1$, $R_2$, $R_3$ or $R_4$ is preferably an alkenyl group having from 2 to 10 carbon atoms (e.g., vinyl, allyl, 1-propenyl, 2-pentenyl, 1,3-butadienyl).

$R_1$ and $R_2$, $R_3$ and $R_4$, or $R_5$ and $R_6$ may be bonded to each other to form a ring, which is preferably a 5-membered or 6-membered ring such as a pyrrolidine ring, a piperidine ring, a morpholine ring or a benzene ring.

The methine group represented by $L_1$, $L_2$, $L_3$, $L_4$ and $L_5$ may optionally have substituent(s) (e.g., methyl and ethyl group and a halogen atom). As the case may be, the substituents on the group may be bonded to each other to form a 5-membered or 6-membered ring (for example, cyclopentene ring, cyclohexene ring, isophorone ring). The methine group is preferably unsubstituted.

Specific examples of dyes of formula (I) are shown below, which, however, are not to be considered as limiting the invention.

(I-1)

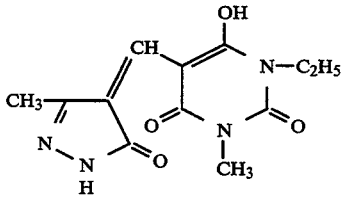

(I-2)

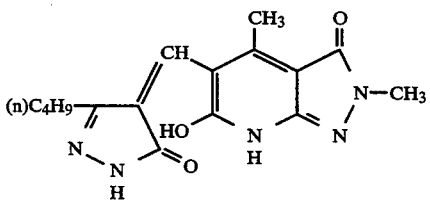

-continued (I-3)

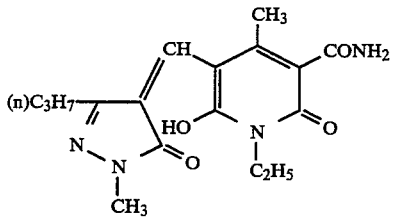

(I-4)

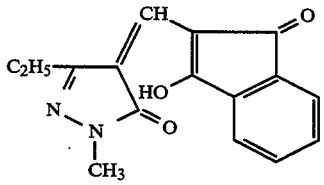

(I-5)

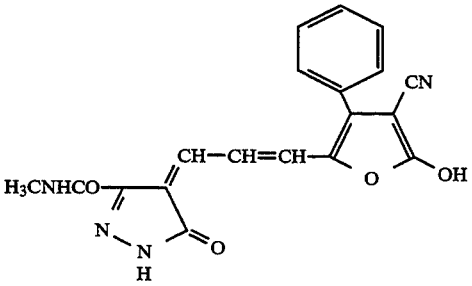

(I-6)

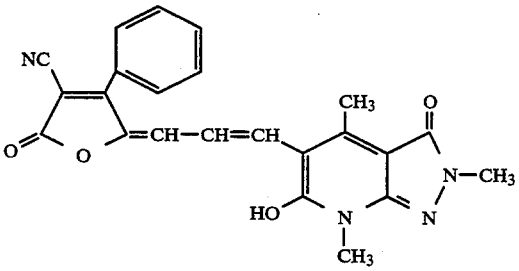

(I-7)

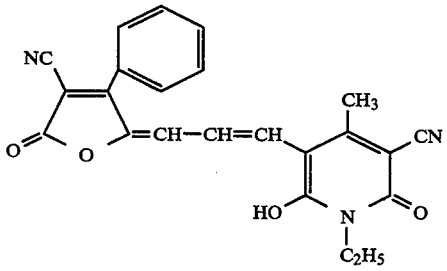

(I-8)

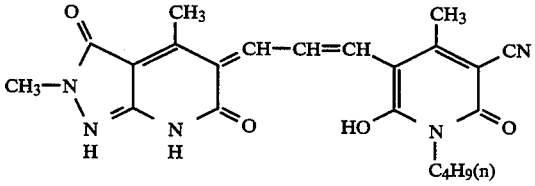

(I-9)

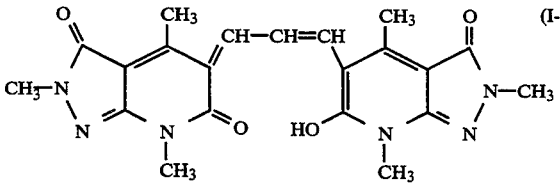

-continued
(I-10)
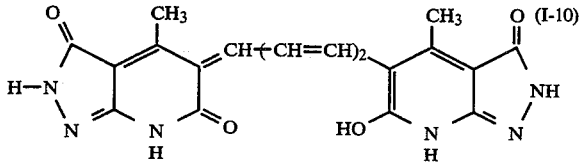
(I-11)
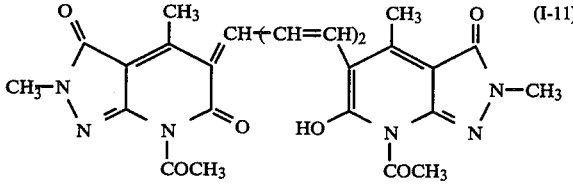
(I-12)
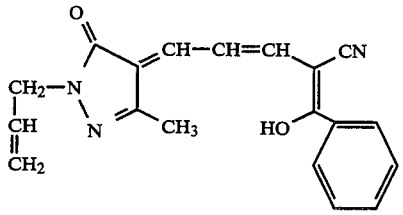
(I-13)
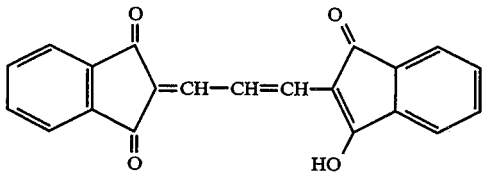
(I-14)
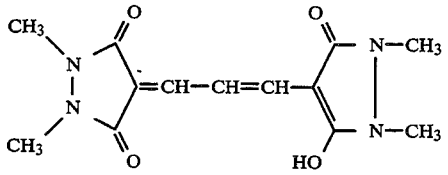
(I-15)
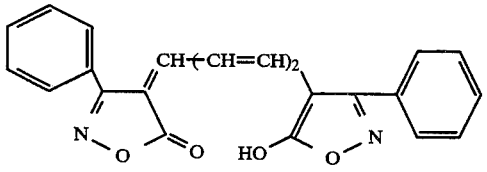
(I-16)
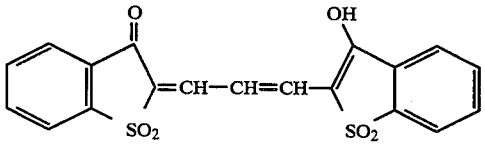
(I-17)
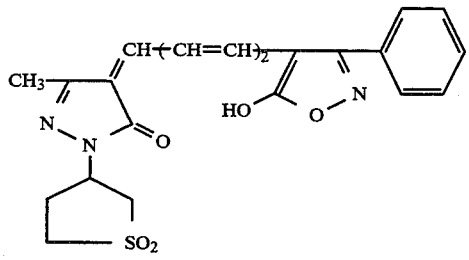
-continued
(I-18)
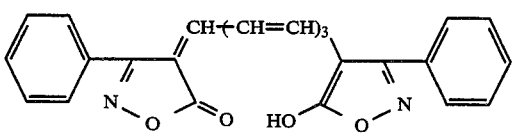
(I-19)
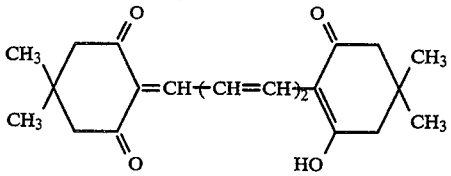
(I-20)
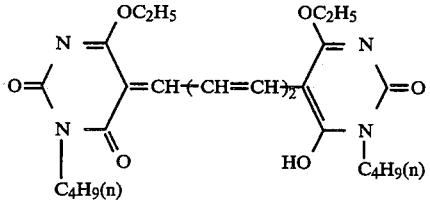
(I-21)
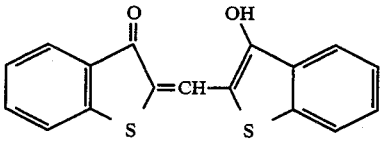
(I-22)
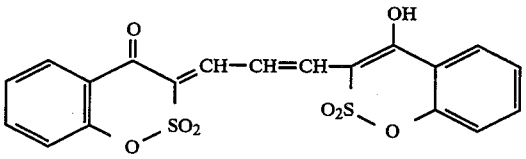
(I-23)
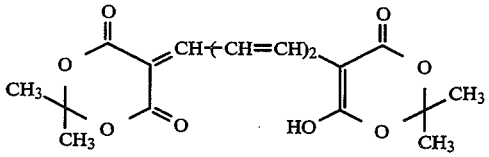
(I-24)
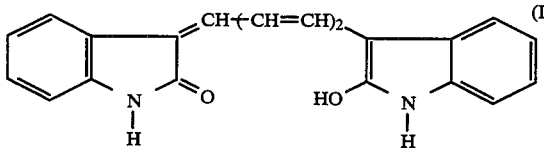
(I-25)
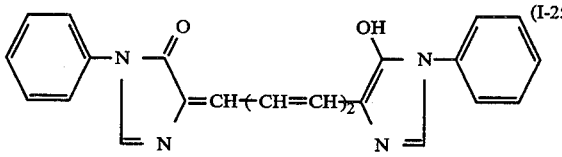
(I-26)
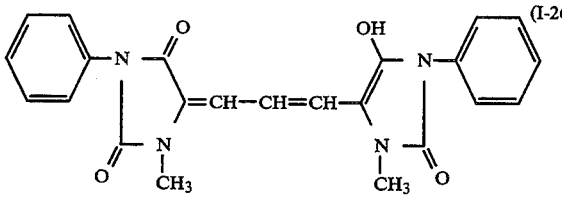

-continued

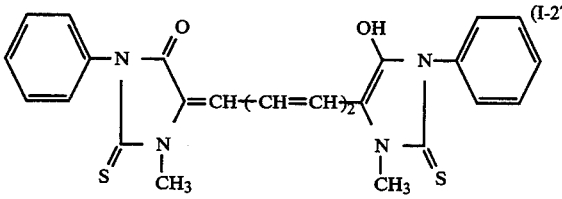

(I-27)

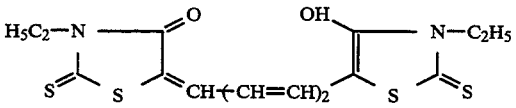

(I-28)

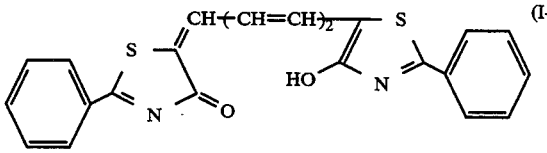

(I-29)

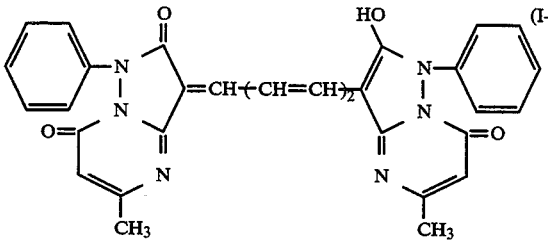

(I-30)

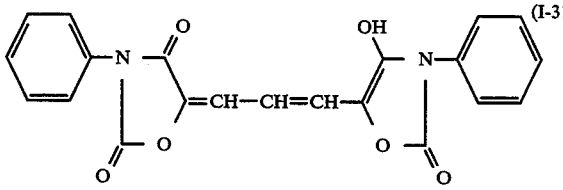

(I-31)

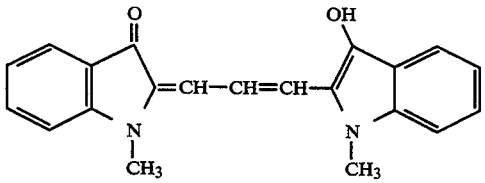

(I-32)

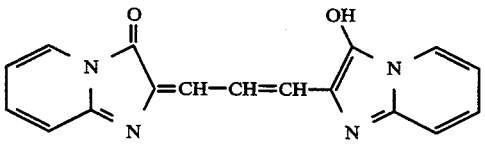

(I-33)

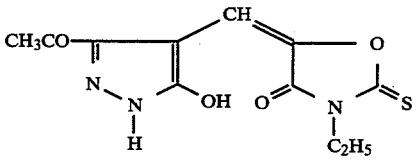

(I-34)

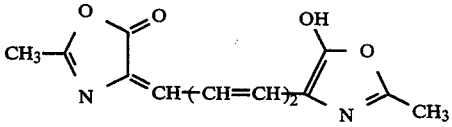

(I-35)

-continued

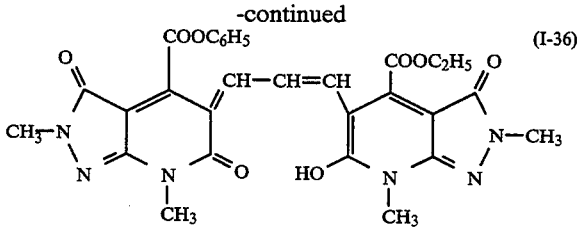

(I-36)

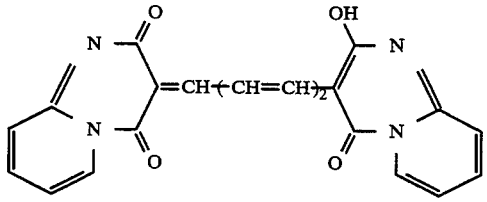

(I-37)

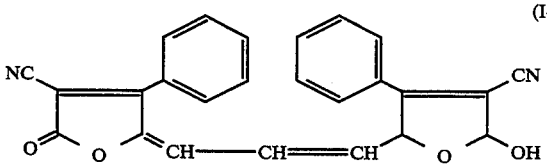

(I-38)

Among these, especially preferred are (I-2), (I-5) to (I-11), (I-36), and (I-38).

Compounds of formula (I) may be produced by conventional methods known by those skilled in the art. For instance, they may be produced by condensation of the corresponding acidic nucleus and a methine source such as ethyl orthoformate, diphenylamidine, 1,1,3,3-tetramethoxypropane, malonaldehyde-dianil or glutaconaldehyde-dianil. Specifically, they are produced by the methods described in JP-A-52-92716, JP-A-55-120030, JP-A-63-27838, JP-A-64-40827, JP-A-2-277044, JP-A-2-282244, JP-A-3-23441, JP-A-3-208044, JP-A-3-192250, JP-A-3-194544, JP-A-3-200248, JP-A-3-204639, JP-A-3-204640, JP-A-3-206441, JP-A-3-206442, JP-A-3-208042, JP-A-3-208043, and JP-A-3-213847.

Dispersion of compounds of formula (I) may be effected by any milling method (for example, with a ball mill, a shaking ball mill, a planet ball mill, a sand mill, a colloid mill, a jet mill, a roller mill). The use of a solvent (e.g. water) is preferred, and the use of a surfactant for dispersion is more preferred. After the compound of formula (I) of the present invention is dissolved in a suitable solvent, a poor solvent for the compound may be added to the resulting solution so as to precipitate fine crystals. Also, a surfactant for dispersion may be used. Alternatively, the compound is first dissolved in a solvent under a controlled pH value of the system, and thereafter the pH value thereof may be varied to give fine crystals in the system.

Fine grains of the compound of the present invention in the dispersion are desired to have a mean grain size from 0.005 μm to 10 μm, preferably from 0.01 μm to 1 μm, more preferably from 0.01 μm to 0.5 μm, especially preferably from 0.01 μm to 0.1 μm.

For dispersion of the compound of formula (I), heating may be effected before and/or after dispersion. For the purpose of more effectively heating the dispersion system, heating is effected at least after dispersion.

The heating method is not specifically limited, provided that the solid dye may be directly heated. The temperature is preferably 40° C. or higher. The uppermost limit of the heating temperature is not specifically limited but is preferably 250° C. or lower. More preferably, the heating temperature is from 50° C. to 150° C.

The heating time also is not specifically limited, provided that the dye is not decomposed by heating. It may be from 15 minutes to 1 week, preferably from 1 hour to 4 days.

For effectively performing the heat treatment, the heating is preferably performing in a solvent. The kind of the solvent to be used for this purpose is not specifically limited, provided that it does not substantially dissolve the dye of formula (I). For instance, suitable solvents include water, alcohols (e.g. methanol, ethanol, isopropyl alcohol, butanol, isoamyl alcohol, octanol, ethylene glycol, diethytene glycol ethyl cellosolve), ketones (e.g., acetone, methyl ethyl ketone), esters (e.g., ethyl acetate, butyl acetate), alkylcarboxylic acids (e.g., acetic acid, propionic acid), nitriles (e.g., acetonitrile), and ethers (e.g., dimethoxyethane, dioxane, tetrahydrofuran).

Where an organic carboxylic acid is added to the dispersing system during heating it, the effect of the present invention may be attained more favorably. Examples of organic carboxylic acids suitable for the purpose include alkylcarboxylic acids (e.g., acetic acid, propionic acid), carboxymethyl celluloses (e.g., CMC), and arylcarboxylic acids (e.g., benzoic acid, salicylic acid).

The amount of the organic carboxylic acid in the system may be from 0.5 to 100 times of the weight of the compound of formula (I) therein, when it acts as a solvent. Where an organic carboxylic acid is added to the system in addition to a solvent other than organic carboxylic acids for the system, the amount of the acid may be from 0.05 to 100% by weight to the weight of the compound of formula (I) in the system.

The amount of the compound of formula (I) in the photographic material of the present invention may be any desired effective amount. It is preferably such that the optical density on one surface of the photographic material may fall within the range of from 0.05 to 3.0. Specifically, the amount on one surface of the compound represented by formula (I) used is preferably from 0.5 $mg/m^2$ to 1,000 $mg/m^2$, more preferably from 1 $mg/m^2$ to 500 $mg/m^2$. The time for adding the compound of formula (I) to the photographic material may be any time before coating.

The compound of formula (I) may be added to the emulsion layer or to any other hydrophilic colloid layer (e.g., interlayer, protective layer, anti-halation layer, filter layer, subbing layer) constituting the photographic material. It may be added to a single layer or a plurality of layers constituting the photographic material.

The typical hydrophilic colloid in the photographic material of the present invention is gelatin. In addition, any other which has heretofore been known as being suitable for photographic materials may be used.

The silver halide emulsion constituting the photographic material of the present invention is preferably an emulsion of silver bromide, silver iodide, silver iodobromide, silver iodochlorobromide, silver chlorobromide or silver chloride.

The silver halide grains in the emulsion may be regular crystalline such as cubic or octahedral grains, or irregular crystalline such as spherical or tabular grains. They may also be composite grains composed of regular and irregular crystalline forms. A mixture comprising different crystalline grains may also be used in the present invention. However, regular crystalline grains are preferred.

Regarding the silver halide grains, photographic emulsions and methods of producing them, as well as the binders or protective colloids, the hardening agents, the sensitizing dyes and the stabilizers or antifoggants in the photographic material of the present invention, those mentioned in JP-A-3-238447, from page 18, left bottom column, line 18 to page 20, left bottom column, line 17 are referred to.

The photographic material of the present invention may contain one or more surfactants for the purposes of aiding coating, prevention of static charges, improvement of sliding property, improvement of emulsification or dispersion, prevention of adhesion and improvement of photographic properties (e.g., elevation of developability, elevation of contrast, sensitization).

The photographic material of the present invention may also contain any dye other than the dyes of the present invention in the hydrophilic colloid layers constituting the material, as a filter dye or for anti-irradiation or anti-halation or for various other purposes. As such dyes, preferred are oxonole dyes, hemioxonole dyes, styryl dyes, merocyanine dyes, anthraquinone dyes, and azo dyes. In addition, also suitable are cyanine dyes, azomethine dyes, triarylmethane dyes and phthalocyanine dyes. If these dyes are soluble in water, they may be added to the layers in the form of a solution. If they are hardly soluble in water, they may be added thereto as a dispersion of solid fine grains. Oil-soluble dyes may be added to the layer in the form of an emulsion by an oil-in-water dispersion method.

The techniques for making and using multi-layer, multi-color photographic materials, supports, methods of coating photographic emulsion layers, means of exposing photographic materials and means of photographic processing of photographic materials, which are described in JP-A-3-238447, from page 20, right bottom column, line 14 to page 27, right top column, line 2, may apply to the present invention.

The present invention will be explained in more detail by way of the following examples, which, however, are not intended to restrict the scope of the present invention.

EXAMPLE 1

Preparation of Tabular Grains

Six g of potassium bromide and 7 g of gelatin were added to one liter of water and heated up to 55° C. in a container. To this mixture were added 37 cc of an aqueous solution of silver nitrate ( containing 4.00 g of silver nitrate) and 38 cc of an aqueous solution containing 5.9 g of potassium bromide with stirring, by a double jet method over a period of 37 seconds. 18.6 g of gelatin was added thereto, and the mixture was heated up to 70° C. To this mixture was added 89 cc of an aqueous solution of silver nitrate (containing 9.8 g of silver nitrate) over a period of 22 minutes. Seven cc of a 25% aqueous ammonia solution was added thereto, and physical ripening of the system was effected for 10 minutes at the elevated temperature. Then, 6.5 cc of a 100% acetic acid solution was added thereto. Subsequently, an aqueous solution containing 153 g of silver nitrate and an aqueous solution of potassium bromide were added thereto, while the pAg of the system was kept at 8.5 by a controlled double jet method over a period of 35 minutes. Next, 15 cc of a 2 N solution of potassium thiocyanate was added thereto. The system was thus subjected to physical ripening for 5 minutes at the elevated temperature, and thereafter the temperature of the system was lowered to 35° C. Accordingly, monodispersed pure silver bromide tabular grains, having a mean projected area diameter of 1.10 μm, a mean thickness of 0.165 μm, and a fluctuation coefficient of the diameter of 185% were obtained.

Soluble salts were removed from the emulsion by flocculation. The emulsion was again heated up to 40° C., and 30 g of gelatin, 2.35 g of phenoxyethanol and, as a thickener, 0.8 g of sodium polystyrenesulfonate were added thereto. The emulsion was then adjusted to a pH of 5.90 and pAg of 8.25, by adding sodium hydroxide and a silver nitrate solution thereto.

The emulsion was then chemically sensitized in the manner mentioned below, with stirring at 56° C.

Precisely, 0.043 mg of thiourea dioxide was first added to the emulsion, which was kept as it was for 22 minutes for reduction sensitization. Next, 20 mg of hydroxy-6-methyl-1,3,3a,7-tetrazaindene and 400 mg of the following sensitizing dye were added thereto:

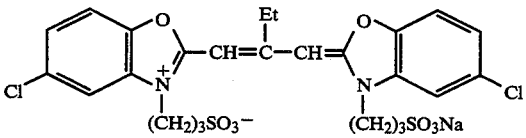

Further, 0.83 g of calcium chloride was added thereto. Subsequently, 1.3 mg of sodium thiosulfate, 2.7 mg of Selenium Compound (1) shown below, 2.6 mg of chloroauric acid and 90 mg of potassium thiocyanate were added thereto. Forty minutes after the final addition, the emulsion was cooled to 35° C. Thus, the preparation of tabular grains (T-1) was completed.

Selenium Compound (1):

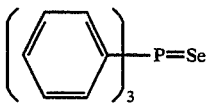

Preparation of Coated Sample

The following chemicals were added to ( T-1 ) to prepare a coating solution, the amounts of each being per mol of silver halide of (T-1). The coating solution was coated on a support to give a coated sample.

| Component | Amount |
|---|---|
| Gelatin (including gelatin in emulsion) | 65.5 g |
| Trimethylolpropane | 9 g |
| Dextran (mean molecular weight: 39,000) | 18.5 g |
| Sodium Polystyrenesulfonate (mean molecular weight: 600,000) | 1.8 g |
| Hardening Agent (1,2-bis(vinylsulfonylacetamido)ethane: to make the swelling percentage 230%) | |
| 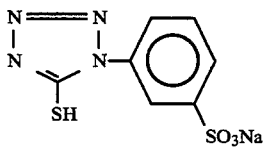 | 34 mg |

-continued

| Component | Amount |
|---|---|
| 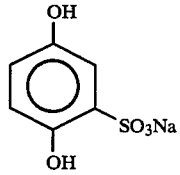 | 4.8 g |

A coating solution for a surface protective layer was prepared from the following components:

| Component | Amount |
|---|---|
| Gelatin | 0.966 g/m² |
| Sodium Polyacrylate (mean molecular weight: 400,000) | 0.023 g/m² |
| 4-Hydroxy-6-methyl-1,3,3a,7-tetrazaindene | 0.015 g/m² |
| 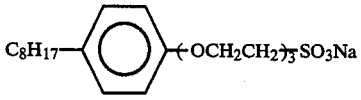 | 0.013 g/m² |
| $C_{16}H_{33}O(CH_2CH_2O)_{10}H$ | 0.045 g/m² |
| $C_{17}H_{33}CON(CH_3)CH_2CH_2SO_3Na$ | 0.0065 g/m² |
| $C_8F_{17}SO_2N(C_3H_7)(CH_2CH_2O)_{15}H$ | 0.003 g/m² |
| $C_8F_{17}SO_2N(C_3H_7)(CH_2CH_2O)_4(CH_2)_4SO_3Na$ | 0.001 g/m² |
| 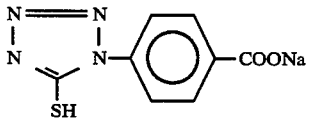 | 1.7 mg/m² |
| Polymethyl Methacrylate (mean grain size 3.7 μm) | 0.087 g/m² |
| Proxel (adjusted to a pH of 7.4 with NaOH) | 0.0005 g/m² |

Preparation of Support

(1) Preparation of Dye Dispersion (D-1) for Subbing Layer

Dye (I-2) of the present invention was treated with a ball mill in the manner described below.

434 ml of water and 791 ml of a 6.7% aqueous solution of Triton X-200 surfactant (TX-200) were put in a 2-liter ball mill. Twenty g of Dye (I-2) was added to the solution. Four hundred ml of zirconium oxide (ZrO) beads (diameter, 2 mm) were added thereto, and the content was milled in the mill for 4 days. Next, 160 g of 12.5% gelatin solution was added thereto. After defoaming, ZrO beads were removed by filtration. The thus obtained dye dispersion was observed to reveal that the grain size distribution of the dispersed dye grains fell within the range of from 0.05 to 1.15/μm as the diameter and that the mean grain size of the grains was 0.37 μm.

By centrifugation, large dye grains having a grain size of 0.9 μm or more were removed.

Thus, dye dispersion (D-1) was obtained.

(2) Preparation of Support

A biaxially stretched polyethylene terephthalate film having a thickness of 183 μm was subjected to corona discharging treatment. A first coating solution having the composition mentioned below was coated on one surface of the film in a coated amount of 5.1 cc/m² by wire bar coater. This coated film was then dried at 175° C. for one minute.

The other surface was also coated in the same manner to provide a first subbing layer on both surfaces of the film. The polyethylene terephthalate used contained 0.04% by weight of a dye having the following structure:

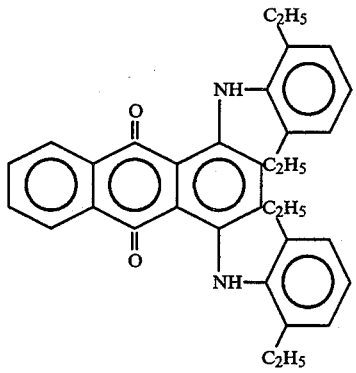

| Composition of Coating Liquid for First Subbing Layer: | |
|---|---|
| Component | Amount |
| Butadiene-styrene Copolymer Latex Solution (solid content 40%; butadiene/styrene = 31/69, by weight) Latex solution contained the following emulsion dispersing agent in an amount of 0.4% by weight to the solid content of the solution: | 79 cc |
| $(n)C_6H_{13}OOCCH_2$ \| $(n)C_6H_{13}OOCCH—SO_3Na$, | |
| Sodium 2,4-Dichloro-6-hydroxy-s-triazine (4% solution) | 20.5 cc |
| Distilled Water | 900.5 cc |

A coating solution having the composition mentioned below was coated on both surfaces, each coated with the preceding first subbing layer, by wire bar coater to form a second subbing layer thereon. This coated film was dried at 150° C.

| Composition of Coating Liquid for Second Subbing Layer: | |
|---|---|
| Component | Amount |
| Gelatin | 160 mg/m² |
| Dye Dispersion (D-1) | 35 mg/m² (as solid content) |
| $C_9H_{19}$—(C₆H₄)—O-(CH₂CH₂O)$_n$H (n = 8.5) | 8 mg/m² |

-continued

| Composition of Coating Liquid for Second Subbing Layer: | |
|---|---|
| Component | Amount |
| 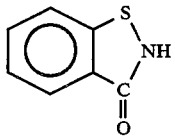 | 0.27 mg/m² |
| Matting Agent (polymethyl methacrylate with mean grain size of 2.5 μm) | 2.5 mg/m² |

Preparation of Photographic Material Samples

The preceding emulsion layer and surface protective layer were coated on both surfaces of the previously prepared support by simultaneous extrusion, to give photographic material Sample (1-1). Photographic material Samples (1-2) to (1-9) were prepared in the same manner as above, except that the dyes indicated in Table 1 below was used in preparing the dye dispersion of solid fine grains in the second subbing layer.

For each sample, the amount of silver coated on one surface was 1.75 g/m².

TABLE 1

| Photographic Material Sample | Dye | Amount Coated (on one surface) (mg/m²) |
|---|---|---|
| 1-1 (Invention) | I-2 | 35 |
| 1-2 (Invention) | I-9 | 35 |
| 1-3 (Invention) | I-15 | 35 |
| 1-4 (Invention) | I-20 | 35 |
| 1-5 (Invention) | I-27 | 35 |
| 1-6 (Invention) | I-32 | 35 |
| 1-7 (Comparison) | Comparative Dye 1 | 35 |
| 1-8 (Comparison) | Comparative Dye 2 (*) | 35 |
| 1-9 (Comparison) | — | — |

(*) Comparative Dye 2 was dissolved into a uniform solution.

Comparative Dye 1 (described in JP-A-64-40827):

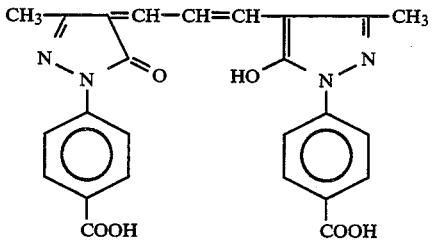

Comparative Dye 2: (described in U.S. Pat. No. 2,274,782, page 2, left column, lines 35 to 45)

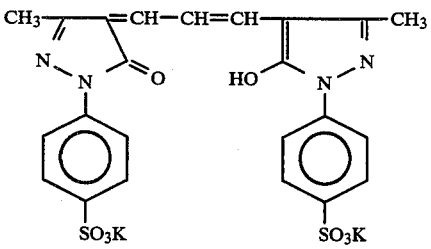

Evaluation of Photographic Properties of Samples

GRENEX Orthoscreen HR-4 (manufactured by Fuji Photo Film Co., Ltd.) was closely attached to one surface of each sample by a cassette to carry out X-ray sensitometry of the sample. Adjustment of the amount of exposure to the sample was effected by varying the distance between the X-ray tube and the cassette. After exposure, the exposed sample was processed with an automatic developing machine, using the following developer and fixer. The sensitivity of each sample was determined as a relative sensitivity to the sensitivity of Sample (1-9) as 100.

Measurement of Sharpness (MTF)

MTF of each sample was measured by the preceding cassette (HR-4 screen was attached to both surfaces) and an automatic developing machine. =The measurement was effected with an aperture of 30 μm×500 μm. Using the MTF value with a space frequency of 1.0 cycle/mm, evaluation was effected in the part having an optical density of 1.0.

Measurement of Color Retention

Each non-exposed sample was processed with the above-mentioned automatic developing machine, and the green transmission density of the processed sample was measured with a Macbeth Status A filter. On the other hand, the green transmission density of a subbing layer-free blue-colored polyethylene terephthalate film support was measured. By subtracting the latter density value (of the subbing layer-free support) from the former density value (of the processed sample), a color retention density value was obtained for evaluation of the sample.

The automatic developing machine used in the experiment was a modified one from FPM-9000 Model (manufactured by Fuji Photo Film Co., Ltd.), in which drying is effected by infrared drying. The processing steps in the modified machine are shown in Table 2 below. The mean amount of samples processed a day was about 200 sheets of a quarto-paper (10 inch×12 inch) size.

TABLE 2

| Processing Step | Amount of Processing Solution in Tank | Processing Temperature | Processing Path Length | Processing Time |
|---|---|---|---|---|
| Development | 15 liters (ratio of surface area to capacity = 25 $cm^2$/liter) | 35° C. | 613 mm | 8.8 sec |
| Fixation | 15 liters | 32° C. | 539 mm | 7.7 sec |
| Rinsing | 13 liters | 17° C. (running water) | 263 mm | 3.8 sec |
| Squeezing | | | 304 mm | 4.4 sec |
| Drying | | 58° C. | 368 mm | 5.3 sec |
| Total | | | 2087 mm | 30.0 sec |

The compositions of the processing solutions used above are set forth below. Replenishment of the processing tanks was effected in the manner mentioned below.

| Preparation of Concentrated Processing Solution: | |
|---|---|
| Developer: | |
| Part Agent (A): | |
| Potassium Hydroxide | 330 g |
| Potassium Sulfite | 630 g |
| Sodium Sulfite | 255 g |
| Potassium Carbonate | 90 g |
| Boric Acid | 45 g |
| Diethylene Glycol | 180 g |
| Diethylenetriaminepentaacetic Acid | 30 g |
| 1-(N,N-diethylamino)ethyl-5-mercaptotetrazole | 0.75 g |
| Hydroquinone | 450 g |
| 4-Hydroxymethyl-4-methyl-1-phenyl-3-pyrazolidone | 40 g |
| Water to make | 4125 ml |
| Part Agent (B): | |
| Diethylene Glycol | 525 g |
| 3,3'-Dithiobishydrosuccinic Acid | 3 g |
| Glacial Acetic Acid | 102.6 g |
| 5-Nitroindazole | 3.75 g |
| 1-Phenyl-3-pyrazolidone | 65 g |
| Water to make | 750 ml |
| Part Agent (C): | |
| Glutaraldehyde (50 wt/wt %) | 150 g |
| Potassium Bromide | 15 g |
| Potassium Metabisulfite | 105 g |
| Water to make | 750 ml |
| Fixer: | |
| Ammonium Thiosulfate (70 wt/vol %) | 3000 ml |
| Disodium Ethylenediaminetetra-acetate Dihydrate | 0.45 g |
| Sodium Sulfite | 225 g |
| Boric Acid | 60 g |
| 1-(N,N-dimethylamino)-ethyl-5-mercaptotetrazole | 15 g |
| Tartaric Acid | 48 g |
| Glacial Acetic Acid | 675 g |
| Sodium Hydroxide | 225 g |
| Sulfuric Acid (36 N) | 58.5 g |
| Aluminum Sulfate | 150 g |
| Water to make | 600 ml |
| pH | 4.68 |

Preparation of Processing Solutions

The respective part agents (A), (B) and (C) of the preceding concentrated developer stocks were separately put in different part containers, which were connected to each other by a container system.

The concentrated fixer was also put in a container of the same kind.

As a starter, 300 ml of an aqueous solution containing 54 g of acetic acid and 55.5 g of potassium bromide was added to the developer tank.

The developer stock container system containing the above part agents was set upside down on the developing machine, with the mouth of each part container being inserted into the perforating blade as equipped on the side wall of the machine to break the seal film of the cap of the container whereby the part agents entered the developer stock tanks.

The respective part agents were thus introduced into the developer tank and the fixer tank of the automatic developing machine in the determined ratio mentioned below, by driving the pumps as equipped to the machine.

At every processing of 8 sheets of quarto-paper (10 inch×12 inch) size photographic material sample, a mixture of the part agents and water of the determined ratio was replenished to each processing tank.

| | |
|---|---|
| Developer: | |
| Part Agent (A) | 55 ml |
| Part Agent (B) | 10 ml |
| Part Agent (C) | 10 ml |
| Water | 125 ml |
| pH | 10.50 |
| Fixer: | |
| Concentrated Fixer | 80 ml |
| Water | 120 ml |
| pH | 4.62 |

The rinsing tank was filled with tap water. The results obtained are shown in Table 3 below.

TABLE 3

| Photographic Material Sample | Dye | Relative Sensitivity (front surface) | MTF | Color Retention |
|---|---|---|---|---|
| 1-1 (Invention) | I-2 | 100 | 0.56 | 0.01 |
| 1-2 (Invention) | I-9 | 100 | 0.56 | 0.01 |
| 1-3 (Invention) | I-15 | 100 | 0.55 | 0.01 |
| 1-4 (Invention) | I-20 | 100 | 0.56 | 0.01 |
| 1-5 (Invention) | I-27 | 100 | 0.56 | 0.01 |
| 1-6 (Invention) | I-32 | 100 | 0.56 | 0.01 |
| 1-7 (Comparison) | Comparative Dye 1 | 88 | 0.55 | 0.03 |
| 1-8 (Comparison) | Comparative Dye 2 | 80 | 0.56 | 0.03 |
| 1-9 (Comparison) | — | 100 | 0.42 | 0.00 |

As is apparent from the results in Table 3 above, all the photographic material samples containing the dye of the present invention had a higher sharpness with less color retention than the comparative samples and that decrease of the sensitivity of the samples of the present invention was smaller than that of the comparative samples.

EXAMPLE 2

Silver halide photographic material Sample (II-1) was prepared by the method described in JP-A-3-249752, from page 24, left top column, line 7 to page 25, left bottom column, line 20, except that a dispersion of dye (I-9) of the present invention, as prepared by the same method as that in Example 1, was used in place of dye (I-1) described in JP-A-3-249752, page 24, left top column, line 18. The amount of dye (I-9) in Sample (II-1) was 140 mg/m$^2$. Other photographic material Samples (II-2) to (II-15) were prepared in the same manner as above, except that dye (I-9) was replaced by the dye as indicated in Table 4 below.

The samples thus prepared were stored under the condition of 40° C. and 80% RH for 3 days and then processed in accordance with the process described in JP-A-3-249752, from page 25, right bottom column, line 8 to page 26, left top column (table). The fresh samples were also processed in the same manner. The difference in the sensitivity between the fresh sample and the stored sample was obtained as the degree of desensitization. The results obtained are shown in Table 4.

TABLE 4

| Sample | Dye(*) | Degree of Desensitization |
|---|---|---|
| II-1 (Invention) | I-9 | 0.03 |
| II-2 (Invention) | I-10 | 0.04 |
| II-3 (Invention) | I-11 | 0.03 |
| II-4 (Invention) | I-15 | 0.04 |
| II-5 (Invention) | I-17 | 0.03 |
| II-6 (Invention) | I-20 | 0.03 |
| II-7 (Invention) | I-25 | 0.04 |
| II-8 (Invention) | I-27 | 0.03 |
| II-9 (Invention) | I-30 | 0.04 |
| II-10 (Invention) | I-35 | 0.03 |
| II-11 (Invention) | I-37 | 0.04 |
| II-12 (Invention) | I-38 | 0.03 |
| II-13 (Comparison) | Comparative Dye 1 | 0.18 |
| II-14 (Comparison) | Comparative Dye 2 | 0.16 |
| II-15 (Comparison) | — | 0.03 |

(*) The amount added is 140 mg/m$^2$.

Comparative Dye 1 (described in JP-A-55-120030):

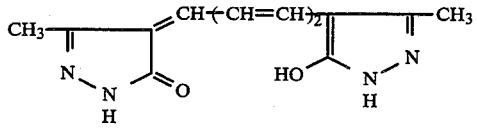

Comparative Dye 2 (described in JP-A-52-92716):

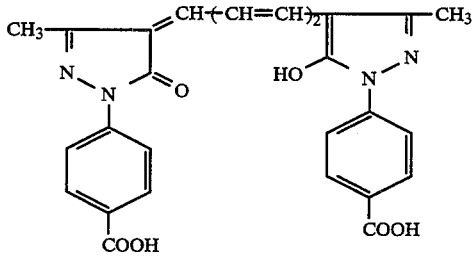

As is apparent from the results of Table 4 above, Samples (II-1) to (II-12) containing the dye of the present invention had higher storage stability than comparative Samples (II-13) and (II-14), as the degree of desensitization of the former after storage is smaller than the that of the latter. After processing, the comparative Samples (II-13) and (II-14) were found to have blue color retention, while Samples (II-1) to (II-12) of the present invention had no color retention. Thus, it is understood that the decolorability of the dyes of the present invention in the processed samples is better than the comparative dyes. In addition, the sharpness of all the dye-added Samples (II-1) to (II-14) was better than that of the dye-free Sample (II-15).

While the invention has been described in detail and with reference to specific embodiments thereof, it will be apparent to one skilled in the art that various changes and modifications can be made therein without departing from the spirit and scope thereof.

What is claimed is:

1. A silver halide photographic element comprising a support having thereon a hydrophilic colloid layer which contains a dispersion of solid fine grains having a mean grain size from 0.005 μm to 10 μm of a compound of formula (I) which is present in the amount of 0.5 to 1,000 mg/m$^2$:

$$A_1=(L_1-L_2)_m=L_3-(L_4=L_5)_n-A_2 \quad (I)$$

wherein $A_1$ and $A_2$ each represents an acidic nucleus necessary for forming an oxonole dye, excepting the case where $A_1$ and $A_2$ are both 2-pyrazolin-5-one nuclei, the case where they are both barbituric acid nuclei, and the case where they are both 2,6(1H,3H)-pyridinedione nuclei, and wherein at least one of the acidic nuclei represented by $A_1$ and $A_2$ is selected from the group consisting of a pyrazolo[3,4-b]pyridine-3,6-dione nucleus, 2(5H)-furanone nucleus,

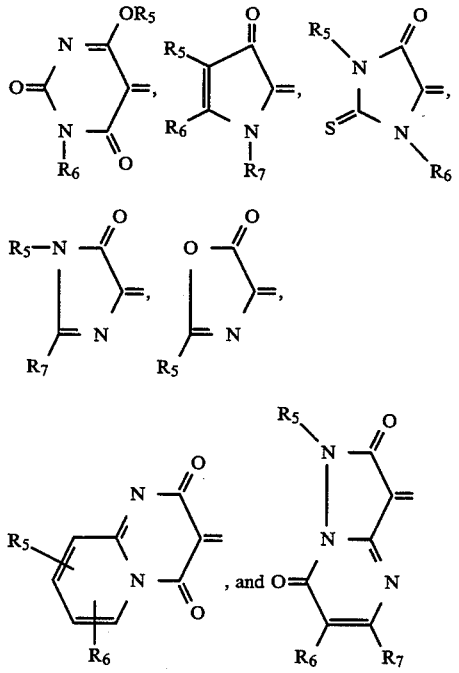

wherein $R_5$, $R_6$ and $R_7$ each represents a hydrogen atom or a substituent; provided that $R_5$ and $R_6$ may be bonded to each other to form a 5-membered or 6-membered ring; $L_1$, $L_2$, $L_3$, $L_4$ and $L_5$ each represents a methine group; and m and n each represents 0, 1 or 2; provided that the compound does not have any dissociating proton-containing substituent or salt thereof capable of dissolving the compound during development, except for the enolic proton constituting a part of the chromophoric group of an oxonole dye.

2. The silver halide photographic element as claimed in claim 1, wherein the acidic nucleus represented by $A_1$ or $A_2$ is a cyclic ketomethylene compound residue or a ketomethylene compound residue substituted by electron-attracting groups.

3. The silver halide photographic element as claimed in claim 1, wherein at least one of the acidic nuclei represented by $A_1$ and $A_2$ is a pyrazolo [3,4-b]pyridine-3,6-dione nucleus or a 2(5H)-furanone nucleus.

4. The silver halide photographic element as claimed in claim 1, wherein the fine grains are present in a hydrophilic colloid layer.

5. The silver halide photographic element as claimed in claim 1, wherein the fine grains are present in an interlayer, a protective layer, an anti-halation layer, a filter layer, or a subbing layer.

6. The silver halide photographic element as claimed in claim 1, wherein the dissociating proton-containing substituent or salt thereof is a sulfonic acid group, a phosphoric acid group, a carboxylic acid group, a sulfonamido group having from 1 to 10 carbon atoms, an arylsulfamoyl group having from 6 to 10 carbon atoms, an acylsulfamoyl group having from 1 to 10 carbon atoms, a sulfonylcarbamoyl group having from 2 to 11 carbon atoms, or a salt thereof.

7. The silver halide photographic element as claimed in claim 1, wherein the solid fine grains of the compound of formula (I) have a mean grain size from 0.01 to 0.5 μm.

8. The silver halide photographic element as claimed in claim 1, wherein the solid fine grains of the compound of formula (I) are present in the amount of 1 to 500 mg/m$^2$.

9. The silver halide photographic element as claimed in claim 1, wherein at least one of the acidic nuclei represented by $A_1$ or $A_2$ is a pyrazolo[3,4-b]pyridine-3,6-dione nucleus.

10. The silver halide photographic element as claimed in claim 1, wherein at least one of the acidic nuclei represented by $A_1$ or $A_2$ is a 2(5H)-furanone nucleus.

11. The silver halide photographic element as claimed in claim 1, wherein at least one of the acidic nuclei represented by $A_1$ or

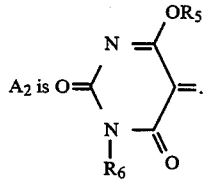

12. The silver halide photographic element as claimed in claim 1, wherein at least one of the acidic nuclei represented by

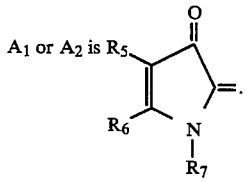

13. The silver halide photographic element as claimed in claim 1, wherein at least one of the acidic nuclei represented by $A_1$ or

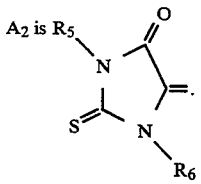

14. The silver halide photographic element as claimed in claim 1, wherein at least one of the acidic nuclei represented by

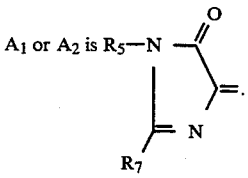

15. The silver halide photographic element as claimed in claim 1, wherein at least one of the acidic nuclei represented by $A_1$ or

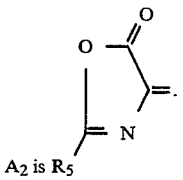

16. The silver halide photographic element as claimed in claim 1, wherein at least one of the acidic nuclei represented by $A_1$ or

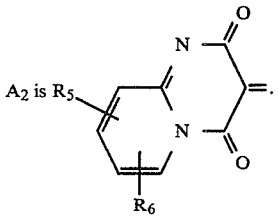

17. The silver halide photographic element as claimed in claim 1, wherein at least one of the acidic nuclei represented by

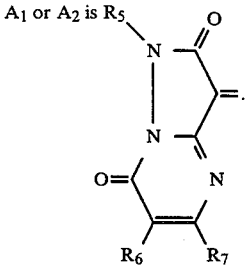

* * * * *